United States Patent [19]

Huslik

[11] 4,277,195

[45] Jul. 7, 1981

[54] WRITING UTENSIL WITH BUILT-IN STAMP AND STAMP PAD

[76] Inventor: Winfried Huslik, Oberstdorfer Str. 4 1/2, Augsburg, Fed. Rep. of Germany

[21] Appl. No.: 49,353

[22] Filed: Jun. 18, 1979

[30] Foreign Application Priority Data

Jun. 23, 1978 [DE] Fed. Rep. of Germany ..... 2827530

[51] Int. Cl.[3] ..... B43K 29/00

[52] U.S. Cl. ..... 401/195; 101/333; 101/405

[58] Field of Search ..... 101/333, 405, 406; 401/195, 52

[56] References Cited

U.S. PATENT DOCUMENTS

| | | | |
|---|---|---|---|
| 317,853 | 5/1885 | Richford | 101/333 |
| 334,008 | 1/1886 | Emerson | 101/333 |
| 377,974 | 2/1888 | Wheless | 401/52 |
| 2,456,904 | 12/1948 | Wahlstoom | 101/333 |
| 2,627,227 | 2/1953 | Claggett et al. | 101/333 |
| 2,783,711 | 3/1957 | Vance | 101/333 |
| 2,896,576 | 7/1959 | Baer | 401/195 |
| 3,246,875 | 4/1966 | Hart | 401/195 |
| 3,618,518 | 11/1971 | Rigoni | 101/333 |
| 4,149,812 | 4/1979 | Huffman, Jr. | 401/195 |

FOREIGN PATENT DOCUMENTS

| | | | |
|---|---|---|---|
| 1131948 | 10/1956 | France | 101/405 |

*Primary Examiner*—William Pieprz

*Attorney, Agent, or Firm*—Jenkins, Coffey, Hyland, Badger & Conard

[57] ABSTRACT

A writing utensil with a built-in stamp and stamp pad includes a body being adapted at one end to carry a stamp and stamp pad and at the other end to write. The body portion carrying the stamp pad is integral with the writing end and at its terminal extremity forms a swivel transverse to the longitudinal axis of the body. A stamp support is carried by the swivel and may be pivoted between a first retracted position where the stamp support is adjacent to the body portion carrying the stamp pad and a second position at least 180° removed from the first position. The stamp and stamp pad are in contact in the first retracted position, and the stamp may be used upon pivoting to the second position.

14 Claims, 4 Drawing Figures

WRITING UTENSIL WITH BUILT-IN STAMP AND STAMP PAD

The invention concerns a writing utensil with a built-in stamp and stamp pad in which a stamp support can be pivoted on a swivel located at the end of the writing utensil opposite to the writing end about an axis that is transverse to the longitudinal axis of the writing utensil from a position which is essentially parallel with the longitudinal axis of the writing utensil and in which the stamp is in contact with the stamp pad to a position essentially transverse to the longitudinal axis.

German Patent Document 29,527 discloses a writing utensil with a built-in stamp and stamp pad. In the writing utensil of this German patent, its end section is comprised of a plurality of components which expand laterally in V-shaped fashion. Hinged to the free end of one of the expanding components is a support carrying the stamp. The stamp-carrying support can be swung out from within the expanding components and attached at its free end to the free end of the other expanding component. The stamp is then located for use outside of the writing utensil and supported from the utensil by a triangular structure formed from the two laterally expanding components. When folded together, the support for the stamp is first disengaged from the other expanding component and flipped back into contact with the expanding component that carries it; and the two expanding components are swung back into their original positions. Thus, the stamp support and the two expanding components are connected with each other and with the body of the writing utensil by means of three joints. The design of such a writing utensil is complicated and susceptible to malfunction. Furthermore, it is rather unstable in use since both expanding components are hinged. Because of the hinged expanding portions, the writing utensil provides an undesirable hinging of the expanding components back and forth even when a cap is slipped over these hinged components. Furthermore, assembly is required before use since the free end of the stamp support must be snapped into position on one of the expanding components in trying to obtain a stamp-supporting structure for use.

U.S. Pat. No. 3,618,518 relates to another writing device with a built-in stamp and stamp pad. In the device of U.S. Pat. No. 3,618,518, two carrier arms, one carrying a stamp and the other carrying a stamp pad, are attached by means of two adjacent hinges at the end of a writing utensil. When not in use, the two carrier arms for the stamp and stamp pad are held together along the logitudinal axis of the writing utensil by a cap. Upon removal of the cap, the carrier arms for the stamp and the stamp pad both pivot outwardly from the longitudinal axis of the utensil about 90° for use. Such writing utensils include two joints and do not permit the writing utensil to be used to apply any significant pressure to the stamp. In such devices, because the stamp and stamp pad are both hinged and free to move back and forth, the end of the writing device is subject to an undesirable instability of the cap even when it is in place.

This invention provides a writing utensil that has a considerably simpler and more stable construction, can be more easily manufactured, possesses a longer useful life and is easier to use than the prior art devices.

In this invention the end of the writing utensil in which the swivel for the stamp is formed is an integral and non-swiveling part of the writing utensil, the swivel is formed at the end of the non-swiveling part, the stamp pad is carried on the non-swiveling part of the writing utensil adjacent the end, and the stamp support with its stamp on the inside can be pivoted at least 180° about the swivel at the end of the writing utensil.

In this invention only the stamp support needs to be swung out into its position by use of its pivot thus reducing the number of movable parts. This results not only in a simplification of manufacturing but also in reduced susceptibility to malfunction and in a longer service life. This construction also has greater stability in use. Since the stamp pad support is formed by a non-swiveling portion of the writing installation, a firm grip is provided for, and by, the cap when it is slipped onto the writing utensil when the stmap is not in use. When the writing utensil is fashioned as a ball-point pen, a smooth transfer of writing force in the longitudinal direction is guaranteed without the back-and-forth motion at the cap end which was possible with the prior art construction. Operation is simplified as only the stamp support is movable, and it is only necessary to move the stamp support from its first retracted position to the second position for use. There is no need to assemble parts or handle movable stamp pad carrying elements.

Between the non-swiveling portion of the writing utensil and the stamp support there is preferably at least one spring provided which urges the stamp support to its second position for use. This is an advantage when a cap is slipped onto the writing utensil end with the stamp. The cap retains the stamp support in its retracted position; and when the cap is pulled off of the writing utensil, the stamp support can automatically swing out. Operation is not only simplified and facilitated, but it is unnecessary that the user touch the stamp support which may contain excess stamp pad ink. The return of the stamp support to the retracted position can be effected with the aid of the cap.

The swivel axis is suitably formed by a pin which can be offset from the longitudinal axis of the writing utensil in the direction of the stamp support. This can result in an improved steadying of the stamp support in its second position since the offset swivel axis permits a larger bearing surface for the stamp support at the end of the writing utensil and can reduce the specific area pressure in use of the pad beyond that possible with a centered swivel axis.

According to a preferred embodiment of the invention, the end of the non-swiveling portion has a reinforcement to receive the pivot which protrudes toward the stamp support and which may be given a forked design for attachment of the hinging end of the stamp support. In its preferred embodiment, the diameter of the reinforcement essentially corresponds to the common thickness of the non-swiveling portion of the writing utensil and of the stamp support in its first retracted position so that a continuous contour is obtained which is particularly suited for slipping on a cap.

It is further preferred to provide a stamp support swivel of more than 270° and preferably about 285°. This increases the lever arm of the bearing and the bearing surface for the stamp support when it is swung out for use by having the lever arm and the bearing surface extend diagonally. It also makes possible a more even distribution of pressure on the stamp face when operated by hand by providing a resultant of operating force acting at the stamp in an imaginary plane formed by the stamp support and the writing utensil.

Further embodiments and advantages of the invention will be apparent from the following descriptions and drawings in which.

Figure 1:
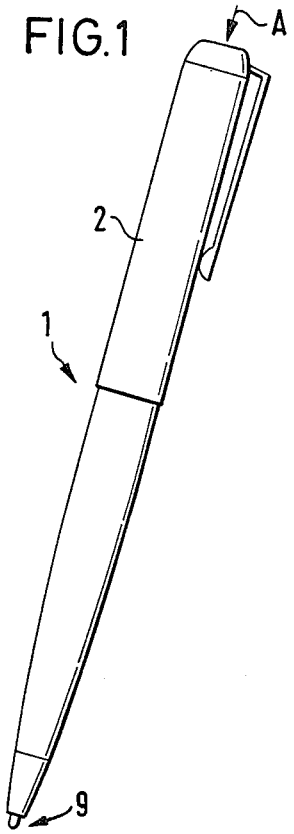
FIG. 1 is a writing utensil of this invention in a pictorial view.
Figure 2:
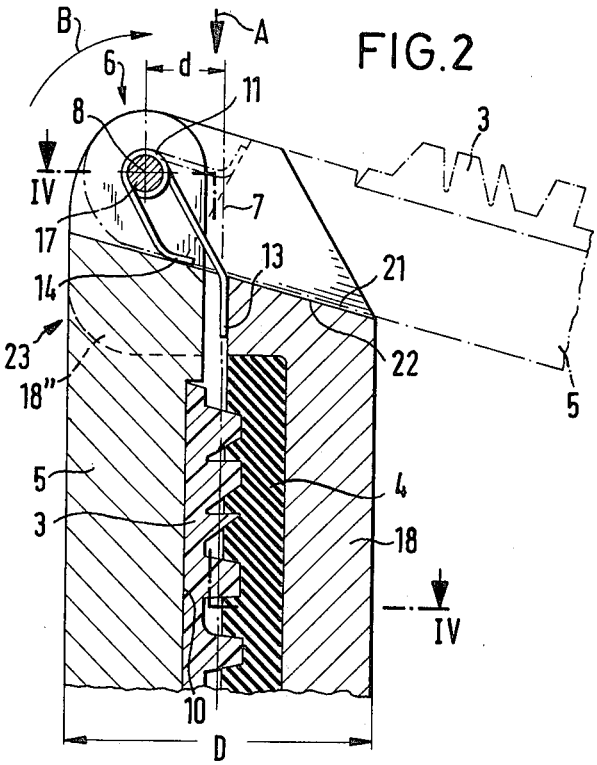
FIG. 2 is a cross-sectional view of a writing utensil of FIG. 1 with the cap removed showing the end of the writing utensil bearing the stamp and the stamp pad.

FIG. 1 shows a writing utensil 1 of this invention in the form of a ball-point pen which can be operated in the customary fashion by pressure on a cap 2 in the direction of arrow A. The cap 2 covers a built-in stamp 3 and stamp pad 4 which are illustrated in FIG. 2. A support 5 to which stamp 3 is attached is mounted so as to swivel on axis 8 arranged on the end 6 of the writing utensil 1 opposite the writing point 9. The axis 8 is transverse to the longitudinal axis 7 of the writing utensil. The pivoting motion of the stamp support takes place between a retracted position which is essentially parallel with the longitudinal axis 7 of the writing utensil and in which the stamp 3 is in contact with the stamp pad 4, all as illustrated in FIG. 2 by solid lines, and to an extended pivoted position which is as illustrated in the dot-dashed lines of FIG. 2.

Figure 4:
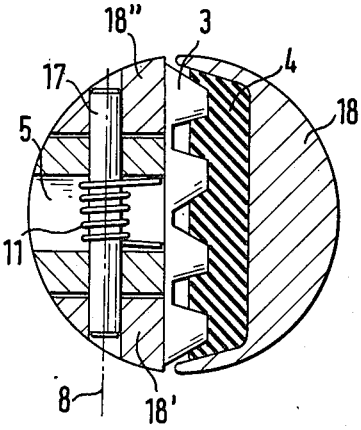
FIG. 4 is a section of FIG. 2 taken along the line IV—IV of FIG. 2.

The end 6 of the writing utensil 1 forming the swivel axis 8 is formed by a non-swiveling portion 18 of the writing utensil. The stamp pad 4 is attached to the non-swiveling portion 18 of the writing utensil adjacent to the swivel axis 8 toward the writing end 9 of the writing utensil. The stamp pad 4 is somewhat recessed in portion 18, which in inking the pad will counteract a soiling of the surrounding stamp pad as shown in FIG. 4. The support 5 carries the stamp 3 on the inside and can be swiveled at least 180° in the direction of arrow B from its first retracted position. The end 6 of the non-swiveling portion 18 of the writing utensil 1 is fashioned as a clevis 18', 18". The stamp support 5 is pivoted between the clevis 18', 18" and a spring 11 is preferably provided within the clevis which preloads the support 5 in its extended or swung-out second position. The spring 11 is preferably a coil spring surrounding the swivel axis 8, bearing with one end 13 on the non-swiveling portion 18 of the writing utensil 1 and with its other end 14 on the stamp support 5. The hinged end of this stamp support is also suitably fashioned as a clevis 15, 16 whose outside surfaces are guided by the inside surfaces of clevis 18', 18".

The swivel axis 8 is suitably formed by a pivot pin 17 which is laterally offset from the longitudinal axis 7 of the writing utensil 1 in the direction of the stamp support 5. The amount of offset is shown in FIG. 2 as spacing d. The design is preferably such that the end 6 with the non-swiveling portion 18 and/or the clevis 18', 18" forms a reinforcement 23 for receiving the pivot pin 17 and protrudes toward the stamp support 5. As can be seen particularly from FIG. 3, the clevis 18', 18" features recesses 19 and 20 which are coaxial with the swivel axis 8 and in which the pivot pin 17 is seated.

Figure 3:
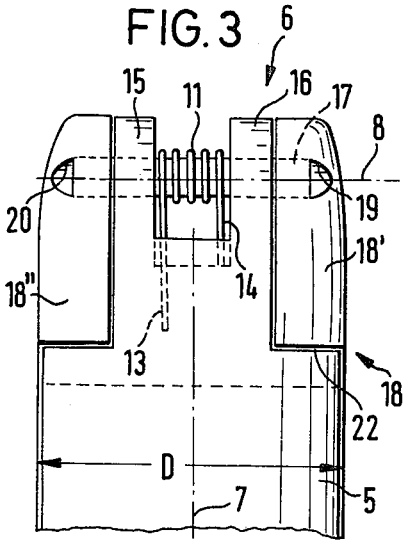
FIG. 3 is a view from the left side of FIG. 2.

As shown distinctly in FIGS. 2 and 3, the diameter D of the reinforcement 23 corresponds with the thickness of the non-swiveling portion 18 and the stamp support 5 when it is in its retracted position (FIG. 2).

It has been found preferable to swing the support 5 of the stamp 3 out by more than 270°, and preferably by about 285°, in the direction of arrow B of FIG. 2 to its second position. The inclined second position thus achieved permits an increase of the bearing surface 21 for the back 22 of stamp support 5 and permits handling to be facilitated and simplified since the force with which the stamp is pressed down on the record to be imprinted can be transferred onto the stamp 3 more evenly.

When the support 5 with the stamp 3 is to be swiveled back opposite to the direction of arrow B to the retracted first position, illustrated in FIG. 2 by solid lines, this is easily accomplished against the relatively weak spring 11. The cap 2 can then again be slipped over and will retain the stamp support 5 in the retracted position illustrated in FIG. 2 by solid lines.

I claim:

1. In a writing utensil with a built-up stamp and stamp pad where a support on which the stamp is mounted can be swiveled around a swivel axis which is located on the end of the utensil opposite the writing end and transverse to the longitudinal axis of the utensil, said swiveling occurring between a retracted position which essentially is parallel with the longitudinal axis and in which the stamp is in contact with the stamp pad, and a swing-out position, the improvement comprising the swivel being formed by the end of a non-swiveling portion of the writing utensil, the stamp pad being arranged on the non-swiveling portion of the writing utensil adjacent the swivel, and the support with the stamp on its inside being pivotal by at least 180°.

2. A writing utensil according to claim 1, wherein between the non-swiveling portion of the writing utensil and the support of the stamp there is at least one spring provided which urges the support to swing-out.

3. A writing utensil according to claim 1 or claim 2, wherein the spring is a coil spring surrounding the swivel axis and bearing with its one end on the non-swiveling portion of the writing utensil while its other end bears on the support of the stamp.

4. A writing utensil according to claim 3, wherein the swivel axis is formed by a pivot pin which is offset relative to the longitudinal axis of the writing utensil toward the support of the stamp.

5. A writing utensil according to claim 1, wherein the support of the stamp can be swiveled by more than 270° and contacts a bearing surface on the non-swiveling portion.

6. A writing utensil according to claim 5, wherein the support of the stamp can be swiveled by about 285°.

7. The writing utensil of claim 1 wherein the second position is over 270° removed from the first position and is determined by a bearing surface of the body portion adjacent to the swivel, thereby permitting the body to be used as a handle to impress the stamp.

8. A writing utensil with a built-in stamp and stamp pad comprising, a body being adapted at one end to carry a stamp and a planar stamp pad and at the other end to write, said one end including a portion integral with the other writing end and carrying the stamp pad and at its terminal extremity forming a swivel transverse to the longitudinal axis of the body, a stamp support carried by the swivel of the body and pivotal between a first retracted position where the stamp support is adjacent the body portion carrying the stamp pad and a second position at least 180° removed from the first position, said stamp and stamp pad being in contact in the first position thereby permitting use of the stamp when pivoted to the second position.

9. The writing utensil of claim 8 or claim 7 wherein the portion of the body forming a swivel is offset from the longitudinal axis of the body in the direction of the stamp support, and the stamp support is substantially parallel to the longitudinal axis of the body throughout its length in the first position, the one end of the body being enclosed within a cap when the stamp is not in use.

10. In a writing utensil with a built-in stamp and planar stamp pad where a support on which the stamp is mounted can be swiveled around a swivel axis which is located on the end of the utensil opposite the writing end and transverse to the longitudinal axis of the utensil, said swiveling occurring between a retracted position which is essentially parallel with the longitudinal axis and in which the stamp is in contact with the stamp pad, and a swing-out position, the improvement comprising the swivel being formed by the end of a non-swiveling portion of the writing utensil with the swivel axis being formed by a pivot pin which is offset relative to the longitudinal axis of the writing utensil in the direction of the stamp support, the stamp pad being arranged and exposed on the non-swiveling portion of the writing utensil adjacent to the swivel and the stamp support being arranged with the stamp on its inside to contact the stamp pad and being pivotal by at least 180°.

11. A writing utensil according to claim 10, wherein the end of the non-swiveling portion features a reinforcement which protrudes toward the support of the stamp and serves to receive the swivel axis.

12. A writing utensil according to claim 11, wherein the reinforcement is fashioned in the area of the swivel axis as a clevis.

13. A writing utensil according to claim 12, wherein the hinged end of the support features a clevis which can be inserted between the clevis of the end and hinged by means of the pivot pin and wherein the coil spring is located on the pivotal pin and enclosed by the clevis of the support.

14. A writing utensil according to claim 11, wherein the diameter of the reinforcement corresponds essentially with the common thickness of the non-swiveling portion and of the support of the stamp in its retracted position.

* * * * *